US007017741B1

(12) United States Patent
Williamson

(10) Patent No.: US 7,017,741 B1
(45) Date of Patent: Mar. 28, 2006

(54) METHOD AND APPARATUS FOR TRANSPORTING PRESSURIZED GAS CANISTERS

(76) Inventor: John P. Williamson, 3025 Roderick St., Morgan City, LA (US) 70380

( * ) Notice: Subject to any disclaimer, the term of this patent is extended or adjusted under 35 U.S.C. 154(b) by 262 days.

(21) Appl. No.: 10/670,119

(22) Filed: Sep. 24, 2003

Related U.S. Application Data

(60) Provisional application No. 60/413,103, filed on Sep. 24, 2002.

(51) Int. Cl.
*B65D 19/00* (2006.01)

(52) U.S. Cl. ..... 206/386; 206/446; 211/85.18; 220/1.5

(58) Field of Classification Search ..... 206/386, 206/391, 393, 394, 443, 446, 521, 585, 600; 211/85.18, 85.8; 108/55.1, 55.3, 56.1; 220/1.5, 220/581
See application file for complete search history.

(56) References Cited

U.S. PATENT DOCUMENTS 3,602,368 A * 8/1971 Gould ..... 206/598
3,765,635 A * 10/1973 Burrell et al. ..... 211/85.18
4,295,431 A * 10/1981 Stavlo ..... 220/1.5
4,481,972 A * 11/1984 Stavlo ..... 206/446
4,564,109 A * 1/1986 Stavlo ..... 206/597
5,078,415 A * 1/1992 Goral ..... 108/55.1
5,176,265 A * 1/1993 Bennett ..... 211/85.18
6,516,730 B1 * 2/2003 Mason ..... 108/55.1

* cited by examiner

*Primary Examiner*—Luan K. Bui
(74) *Attorney, Agent, or Firm*—Garvey, Smith, Nehrbass & North, L.L.C.; Charles C. Garvey, Jr.

(57) ABSTRACT

The present invention discloses a pressurized gas canister transport apparatus and a method of use. The apparatus includes a frame that is specially configured to carry a plurality of generally cylindrically shaped pressurized gas canisters. The frame features upper and lower panels that are connected to a central panel, the central panel providing structural reinforcement and also separating selected canisters from one another, such as oxygen canisters from canisters containing combustible materials. A clamping arrangement is provided for safely holding the canisters in position. In addition, should the canisters become dislodged from their clamps, an additional safety arrangement is provided in the form of railings that are transversely extending and which span between corner columns of the frame to prevent escape of canisters even if they become dislodged from their clamps.

50 Claims, 3 Drawing Sheets

METHOD AND APPARATUS FOR TRANSPORTING PRESSURIZED GAS CANISTERS

CROSS-REFERENCE TO RELATED APPLICATIONS

Priority of U.S. Provisional Patent Application Ser. No. 60/413,103, filed Sep. 24, 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to cargo transportation racks and more particularly to an improved transport apparatus for transporting pressurized gas canisters.

2. General Background of the Invention

In the offshore oil and gas well drilling and production industries, there are a number of oil and gas well drilling and production facilities located in a marine environment. Many of these facilities are offshore oil and gas well drilling and production platforms located in very deep water. They are often many miles from the nearest port.

A problem exists in the safe and economical transport of supplies to offshore oil and gas well drilling and production platforms. A particular problem is the transportation of pressurized gas canisters that are needed on offshore oil well drilling and production platforms to perform tasks such as, for example, welding.

BRIEF SUMMARY OF THE INVENTION

The present invention solves these prior art problems and shortcomings by providing a pressurized gas canister transport apparatus that includes a frame that has a bottom panel, a periphery, an upper panel that has a periphery, and a central, generally vertically extending panel that has an upper end portion attached to the top panel and a lower end portion attached to the bottom panel.

One or more inclined structural members connect the upper and lower panels at positions spaced away from the central panel.

First and second tank storage spaces are provided on opposing sides of the central panel and extend between the upper and lower panels.

A plurality of clamps are connected to the central panel and include clamps on opposing sides of the central panel.

Transversely extending members stand between the inclined members at positions in between the upper and lower panels and each clamp has bolted connections that enable the clamps to hold a pressurized gas canister when the bolted connection is tightened and to release a gas cylinder when the bolted connection is loosened.

The gas canister transport apparatus further includes each clamp having a first section attached to the central panel and a second section that removably attaches to the first section with said bolted connections.

The first section is preferably shaped to conform generally to the outer surface of a generally cylindrically shaped pressurized gas canister to be transported.

The clamps can include a plurality of upper clamps and a plurality of lower clamps that are positioned below the upper clamps.

The transversely extending members include upper transversely extending members and lower transversely extending members that are below the upper transversely extending members.

The inclined structural members are generally vertically positioned.

The frame preferably has four corners, each corner being occupied by one of said inclined structural members.

The upper panel and central panel are preferably welded together with a welded connection.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
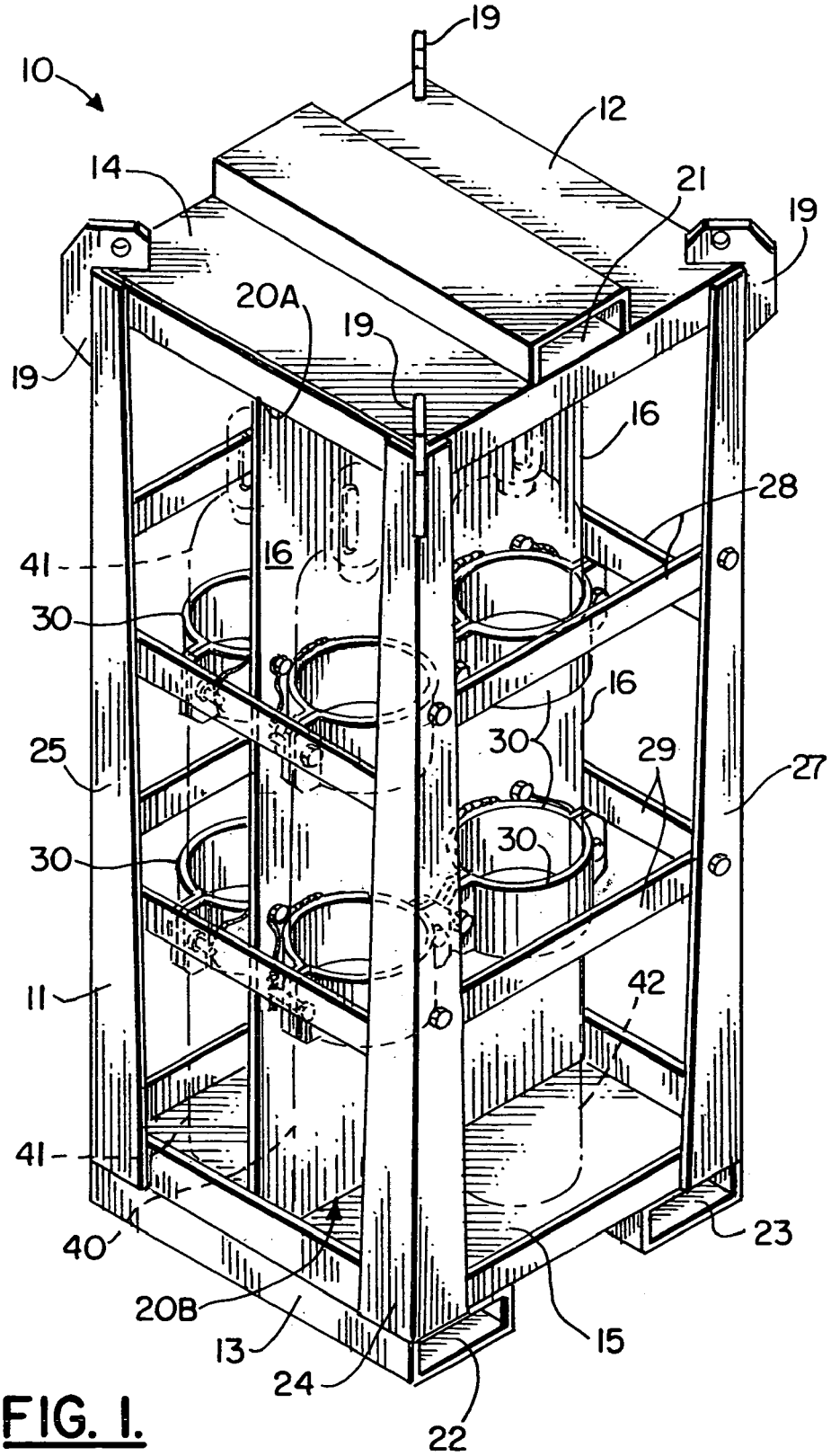
FIG. 1 is a perspective view of the preferred embodiment of the apparatus of the present invention.
Figure 2:
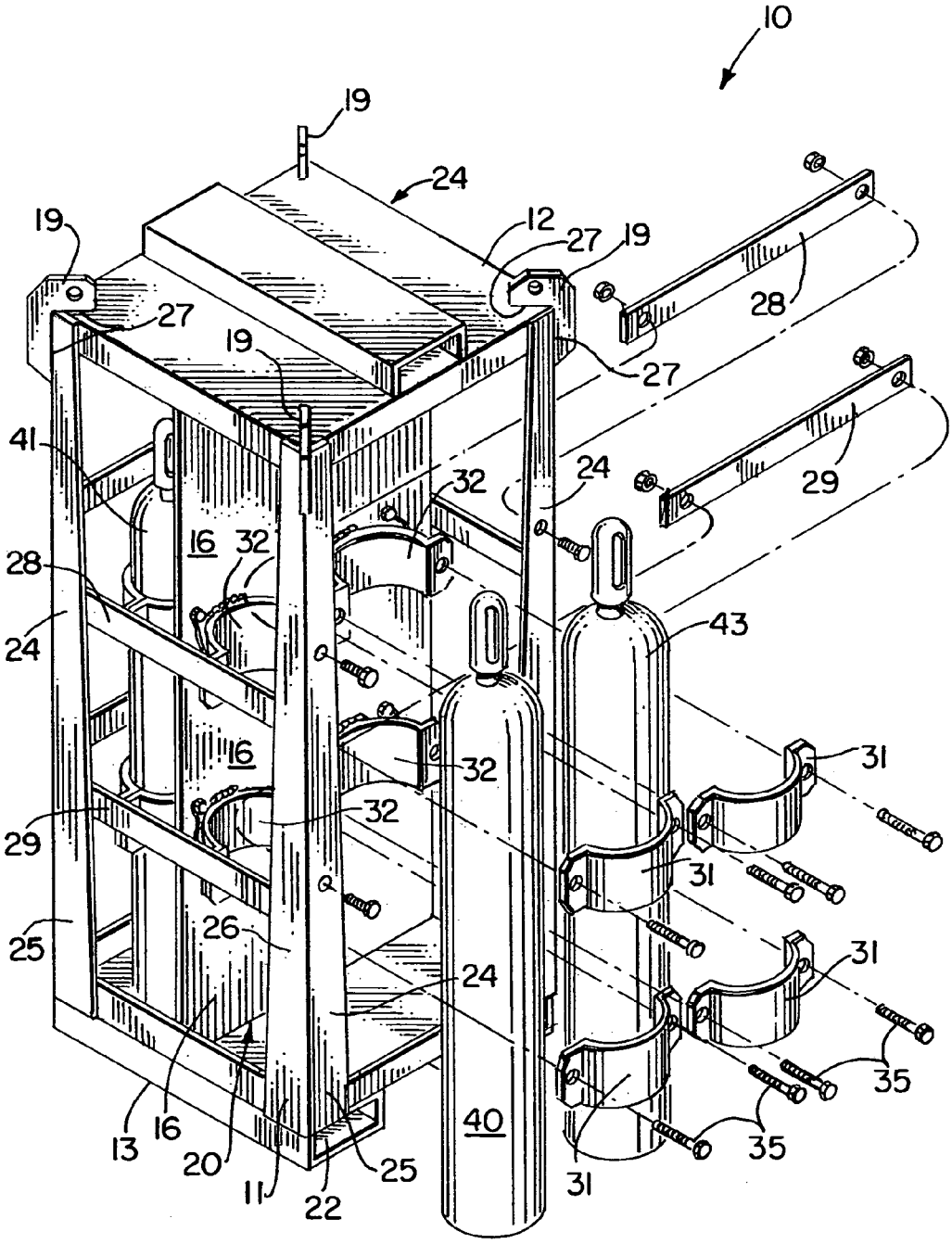
FIG. 2 is a perspective, exploded view of the preferred embodiment of the apparatus of the present invention.
Figure 3:
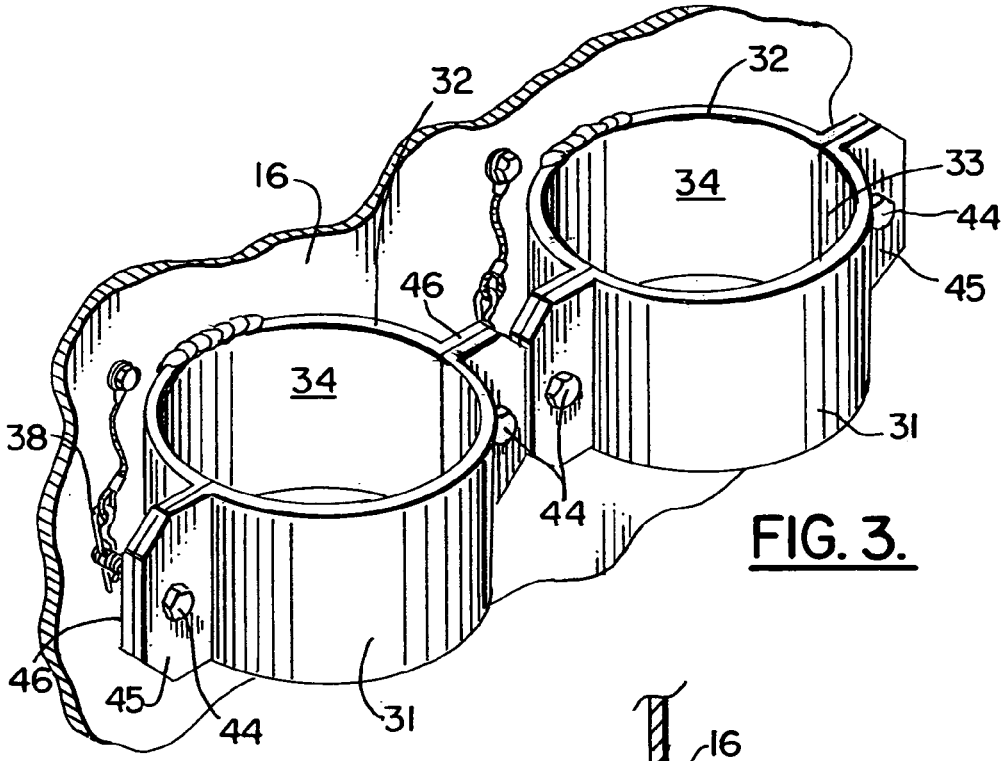
FIG. 3 is a fragmentary of the preferred embodiment of the apparatus of the present invention.
Figure 4:
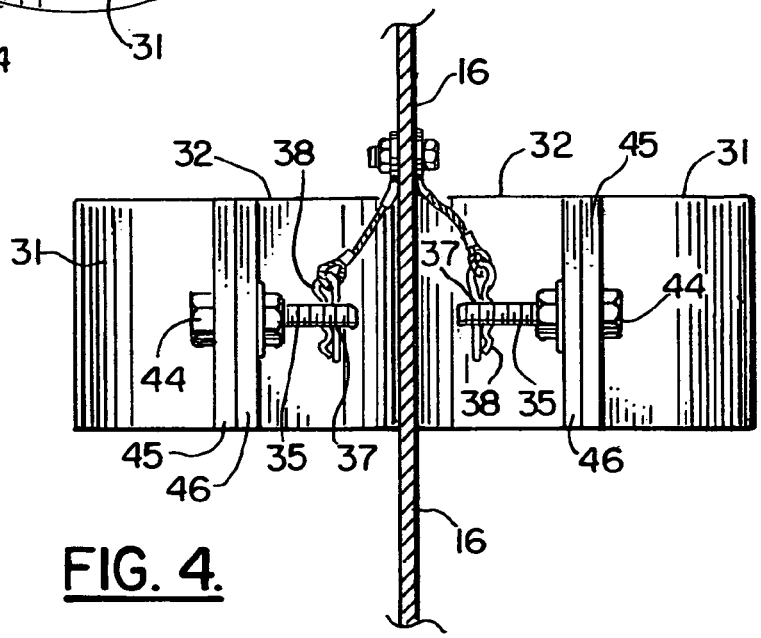
FIG. 4 is a fragmentary, sectional view of the preferred embodiment of the apparatus of the present invention.

Gas canister transport apparatus 10 is shown in FIGS. 1–2. The apparatus 10 includes a frame 11 having an upper end portion 12 and a lower end portion 13. Frame 11 includes an upper panel 14 and a lower panel 15 connected with a central vertically extending panel 16. Lower panel 15 can be reinforced with beams, transverse plates, or the like to help support the weight of cannisters 40 43. An upper welded connection 20A joins the upper panel 14 to the central panel 16. A lower welded connection 20B preferably joins the central panel 16 to the lower panel 15.

A plurality of lifting eyes 19 are provided on the upper panel 14 for enabling a sling or a plurality of slings to be fitted to the apparatus 10 at the lifting eyes 19 so that the apparatus 10 can be lifted with a crane or like lifting device. Each lifting eye preferably connects at weld 27 to both top panel 12 and a column 24.

A plurality of forklift receptacle openings 21–23 are provided that enable a forklift to engage its tines into the receptacles 21–23 for lifting the device and moving it about a dock, vessel deck, or platform floor. Receptacle 21 is an upper receptacle attached to upper panel 12. Receptacles 22, 23 are lower receptacles attached to lower panel 15.

A plurality of four inclined or vertical column members 24 are provided, preferably one member 24 at each corner of upper and lower panels 14, 15. A plurality of transverse members are provided, including a plurality of upper transverse members 28 and a plurality of lower transverse members 29. Each transverse member spans between two columns 24 as shown in FIGS. 1–2. Each vertical or inclined member 24 is ell shaped in transverse cross section, providing two flanges 25, 26 that join to form a ninety degree angle.

The apparatus 10 provides a plurality of clamps 30, each having a pair of clamp sections 31, 32. Each clamp section 31, 32 has a respective conforming surface 33, 34 that conforms generally to a cylindrically shaped pressurized gas canister 40–43 to be transported using the apparatus 10. Each section has opposed flanges 45, 46. Bolted connections 44 are provided for clamping a first clamp section 31 to a second clamp section 32. Bolted connections 44 each include a bolt 35 and of nut 36. Each of the bolts 35 has an opening 37 through which a cotter pin 38 can be inserted to prevent any disengagement of the nut 36 and bolt 35 over a period of time, such as during shipment.

In use, the apparatus 10 can carry a plurality of preferably four or more gas canisters, preferably positioning oxygen canisters 41 on one side of central panel 16 and canisters containing combustible materials such as acetylene 42 on an opposite side. An acetylene canister 42 is shown in the drawings. Other canisters 43 can include, for example, oxygen and nitrogen.

PARTS LIST

The following is a list of suitable parts and materials for the various elements of the preferred embodiment of the present invention.

| PART NO. | DESCRIPTION |
|---|---|
| 10 | gas canister transport apparatus |
| 11 | frame |
| 12 | upper end portion |
| 13 | lower end portion |
| 14 | upper panel |
| 15 | lower panel |
| 16 | central panel |
| 17 | upper welded connection |
| 18 | lower welded connection |
| 19 | lifting eye |
| 20A | weld |
| 20B | weld |
| 21 | upper forklift receptacle |
| 22 | lower forklift receptacle |
| 23 | lower forklift receptacle |
| 24 | inclined or vertical member |
| 25 | flange |
| 26 | flange |
| 27 | weld |
| 28 | upper transverse member |
| 29 | lower transverse member |
| 30 | clamp |
| 31 | clamp section |
| 32 | clamp section |
| 33 | conforming surface |
| 34 | conforming surface |
| 35 | bolt |
| 36 | nut |
| 37 | opening |
| 38 | cotter pin |
| 39 | flange |
| 40 | gas canister |
| 41 | oxygen canister |
| 42 | acetylene canister |
| 43 | other canister |
| 44 | bolted connection |
| 45 | flange |
| 46 | flange |

The foregoing embodiments are presented by way of example only; the scope of the present invention is to be limited only by the following claims.

What is claimed is:

1. A pressurized gas canister transport apparatus comprising:

a) a frame that has a bottom panel, having a periphery, an upper panel having a periphery, and a central generally vertically extending panel that has an upper end portion attached to the top panel and a lower end portion attached to the bottom panel;

b) one or more inclined structural members that connect the upper and lower panels at positions spaced away from the central panel;

c) first and second tank storage spaces being provided on opposing sides of the central panel and extending between the upper and lower panels;

d) a plurality of clamps connected to the central panel and including clamps on opposing sides of said central panel; and e) transversely extending members that span between said inclined members at positions in between said upper and lower panels; and f) each clamp having bolted connections that enable the clamps to hold a pressurized gas canister when the bolted connection is tightened and to release a gas cylinder when the bolted connection is loosened.

2. The pressurized gas canister transport apparatus of claim 1 wherein each clamp includes a first section attached to the central panel and a second section that removably attaches to the first section with said bolted connections.

3. The pressurized gas canister transport apparatus of claim 2 wherein said first section is shaped to conform to the outer surface of generally a pressurized gas canister being transported.

4. The pressurized gas canister transport apparatus of claim 2 wherein said second section is shaped to conform to the outer surface of generally a pressurized gas canister being transported.

5. The pressurized gas canister transport apparatus of claim 1 wherein the clamps include a plurality of upper clamps and a plurality of lower clamps that are below the upper clamps.

6. The pressurized gas canister transport apparatus of claim 1 wherein the transversely extending members include upper transversely extending members and lower transversely extending members that are below the upper transversely extending members.

7. The pressurized gas canister transport apparatus of claim 1 wherein the inclined structural members are generally vertically positioned.

8. The pressurized gas canister transport apparatus of claim 7 wherein the frame has four corners, each corner being occupied by one of said inclined structural members.

9. The pressurized gas canister transport apparatus of claim 1 wherein the upper panel and central panel are welded together with a welded connection.

10. The pressurized gas canister transport apparatus of claim 1 wherein the lower panel and central panel are welded together with a welded connection.

11. The pressurized gas canister transport apparatus of claim 1 further comprising a plurality of lifting receptacles on the frame that enable the frame to be lifted by more than one type of lifting device, at least one device being a forklift, and another of the devices being a crane.

12. The pressurized gas canister transport apparatus of claim 11 wherein one of the lifting receptacles is attached to the bottom panel.

13. The pressurized gas canister transport apparatus of claim 11 wherein one of the lifting receptacles is attached to the upper panel.

14. The pressurized gas canister transport apparatus of claim 1 wherein at least three levels of safety are associated with the frame for preventing inadvertent removal of a pressurized gas canister from the frame during use, said level of safety being defined by: 1) the bolted connection that holds the as canister to the central panel; 2) the inclined and transverse members being configured to hold a canister in one of the storage spaces; and 3) a cotter pin that prevents loosening of a bolted connection.

15. The pressurized gas canister transport apparatus of claim 11 wherein one of the lifting receptacles is attached to the bottom panel.

16. The pressurized gas canister transport apparatus of claim 11 wherein one of the lifting receptacles is attached to the upper panel.

17. The pressurized gas canister transport apparatus of claim 1 wherein at least three levels of safety are associated with the frame for preventing inadvertent removal of a pressurized gas canister from the frame during use, said level of safety being defined by: 1) the bolted connection that holds the as canister to the central panel; 2) the inclined and transverse members being configured to hold a canister in one of the storage spaces; and 3) a cotter pin that prevents loosening of a bolted connection.

18. A pressurized gas canister transport apparatus comprising:

a) a frame that has a bottom panel, having a periphery, an upper panel having a periphery, and a central generally vertically extending panel that has an upper end portion attached to the top panel and a lower end portion attached to the bottom panel;

b) one or more inclined structural members that connect the upper and lower panels at positions spaced away from the central panel;

c) first and second tank storage spaces being provided on opposing sides of the central panel and extending between the upper and lower panels;

d) a plurality of clamps connected to the central panel and including clamps on opposing sides of said central panel; and e) transversely extending members that span between said inclined members at positions in between said upper and lower panels; and f) each clamp having bolted connections that enable the clamps to hold a pressurized gas canister when the bolted connection is tightened and to release a gas cylinder when the bolted connection is loosened;

g) the upper and lower panels each having a lifting receptacle that enables a lifting device to connect to the receptacle enabling the lifting device to lift the frame.

19. The pressurized gas canister transport apparatus of claim 18 wherein each clamp includes a first section attached to the central panel and a second section that removably attaches to the first section with said bolted connections.

20. The pressurized gas canister transport apparatus of claim 18 wherein said first section is shaped to conform to the outer surface of generally a pressurized gas canister being transported.

21. The pressurized gas canister transport apparatus of claim 18 wherein said second section is shaped to conform to the outer surface of generally a pressurized gas canister being transported.

22. The pressurized gas canister transport apparatus of claim 18 wherein the clamps include a plurality of upper clamps and a plurality of lower clamps that are below the upper clamps.

23. The pressurized gas canister transport apparatus of claim 18 wherein the transversely extending members include upper transversely extending members and lower transversely extending members that are below the upper transversely extending members.

24. The pressurized gas canister transport apparatus of claim 18 wherein the inclined structural members are generally vertically positioned.

25. The pressurized gas canister transport apparatus of claim 18 wherein the frame has four corners, each corner being occupied by one of said inclined structural members.

26. The pressurized gas canister transport apparatus of claim 18 wherein the upper panel and central panel are welded together with a welded connection.

27. The pressurized gas canister transport apparatus of claim 18 wherein the lower panel and central panel are welded together with a welded connection.

28. The pressurized gas canister transport apparatus of claim 18 wherein at least three levels of safety are associated with the frame for preventing inadvertent removal of a pressurized gas canister from the frame during use, said level of safety being defined by: 1) the bolted connection that holds the as canister to the central panel; 2) the inclined and transverse members being configured to hold a canister in one of the storage spaces; and 3) a cotter pin that prevents loosening of a bolted connection.

29. A pressurized gas canister transport apparatus comprising:

a) a liftable frame that has a bottom panel having a periphery, an upper panel having a periphery, and a central generally vertically extending panel that has an upper end portion attached to the top panel and a lower end portion attached to the bottom panel along a line that divides the top into two sections;

b) a plurality of inclined structural corner members that connect the upper and lower panels at corner positions spaced away from the central panel;

c) first and second tank storage spaces being provided on opposing sides of the central panel and extending between the upper and lower panels each storage tank space being sized and shaped to hold at least two gas canisters;

d) a plurality of clamps connected to the central panel and including clamps on opposing sides of said central panel and at multiple elevations; and e) transversely extending members that span between said each of inclined said corner members at positions in between said upper and lower panels; and f) each clamp having removable connections that enable the clamps to hold a pressurized gas canister when the removable connection is tightened and to release a gas cylinder when the removable connection is removed.

30. The pressurized gas canister transport apparatus of claim 29 wherein each clamp includes a first section attached to the central panel and a second section that removably attaches to the first section with said bolted connections.

31. The pressurized gas canister transport apparatus of claim 30 wherein said first section is shaped to conform to the outer surface of generally a pressurized gas canister being transported.

32. The pressurized gas canister transport apparatus of claim 30 wherein said second section is shaped to conform to the outer surface of generally a pressurized gas canister being transported.

33. The pressurized gas canister transport apparatus of claim 29 wherein the clamps include a plurality of upper clamps and a plurality of lower clamps that are below the upper clamps.

34. The pressurized gas canister transport apparatus of claim 29 wherein the transversely extending members include upper transversely extending members and lower transversely extending members that are below the upper transversely extending members.

35. The pressurized gas canister transport apparatus of claim 29 wherein the inclined structural members are generally vertically positioned.

36. The pressurized gas canister transport apparatus of claim 35 wherein the frame has four corners, each corner being occupied by one of said inclined structural members.

37. The pressurized gas canister transport apparatus of claim 29 wherein the upper panel and central panel are welded together with a welded connection.

38. The pressurized gas canister transport apparatus of claim 29 wherein the lower panel and central panel are welded together with a welded connection.

39. The pressurized gas canister transport apparatus of claim 29 further comprising a plurality of lifting receptacles on the frame that enable the frame to be lifted by more than one type of lifting device, at least one device being a forklift, and another of the devices being a crane.

40. A pressurized gas canister transport apparatus comprising:

a) a liftable frame that has a bottom panel, having a periphery, an upper panel having a periphery, and a central generally vertically extending panel that has an upper end portion attached to the top panel and a lower end portion attached to the bottom panel said frame having connectors at the top panel and at the bottom panel for attaching a lifting device to the frame at a selected upper or lower position;

b) one or more inclined structural members that connect the upper and lower panels at positions spaced away from the central panel;

c) first and second tank storage spaces being provided on opposing sides of the central panel and extending between the upper and lower panels;

d) a plurality of clamps connected to the central panel and including clamps on opposing sides of said central panel; and e) transversely extending members that span between said inclined members at positions in between said upper and lower panels; and f) each clamp having bolted connections that enable the clamps to hold a pressurized gas canister when the bolted connection is tightened and to release a gas cylinder when the bolted connection is loosened;

g) the upper and lower panels each having a lifting receptacle that enables a lifting device to connect to the receptacle enabling the lifting device to lift the frame.

41. The pressurized gas canister transport apparatus of claim 40 wherein each clamp includes a first section attached to the central panel and a second section that removably attaches to the first section with said bolted connections.

42. The pressurized gas canister transport apparatus of claim 40 wherein said first section is shaped to conform to the outer surface of generally a pressurized gas canister being transported.

43. The pressurized gas canister transport apparatus of claim 40 wherein said second section is shaped to conform to the outer surface of generally a pressurized gas canister being transported.

44. The pressurized gas canister transport apparatus of claim 40 wherein the clamps include a plurality of upper clamps and a plurality of lower clamps that are below the upper clamps.

45. The pressurized gas canister transport apparatus of claim 40 wherein the transversely extending members include upper transversely extending members and lower transversely extending members that are below the upper transversely extending members.

46. The pressurized gas canister transport apparatus of claim 40 wherein the inclined structural members are generally vertically positioned.

47. The pressurized gas canister transport apparatus of claim 40 wherein the frame has four corners, each corner being occupied by one of said inclined structural members.

48. The pressurized gas canister transport apparatus of claim 40 wherein the upper panel and central panel are welded together with a welded connection.

49. The pressurized gas canister transport apparatus of claim 40 wherein the lower panel and central panel are welded together with a welded connection.

50. The pressurized gas canister transport apparatus of claim 40 wherein at least three levels of safety are associated with the frame for preventing inadvertent removal of a pressurized gas canister from the frame during use, said level of safety being defined by: 1) the bolted connection that holds the as canister to the central panel; 2) the inclined and transverse members being configured to hold a canister in one of the storage spaces; and 3) a cotter pin that prevents loosening of a bolted connection.

* * * * *